US009629405B2

(12) United States Patent
Cornish

(10) Patent No.: US 9,629,405 B2
(45) Date of Patent: Apr. 25, 2017

(54) ENHANCED BIONIC RESISTANCE SUIT

(71) Applicant: Adrian Romando Cornish, Baton Rouge, LA (US)

(72) Inventor: Adrian Romando Cornish, Baton Rouge, LA (US)

( * ) Notice: Subject to any disclaimer, the term of this patent is extended or adjusted under 35 U.S.C. 154(b) by 0 days.

(21) Appl. No.: 14/659,479

(22) Filed: Mar. 16, 2015

(65) Prior Publication Data

US 2015/0258362 A1 Sep. 17, 2015

Related U.S. Application Data

(63) Continuation-in-part of application No. 14/214,985, filed on Jun. 4, 2014, now abandoned.

(51) Int. Cl.

| | |
|---|---|
| ***A63B 21/00*** | (2006.01) |
| ***A41F 9/00*** | (2006.01) |
| ***A63B 21/055*** | (2006.01) |
| ***A63B 23/035*** | (2006.01) |
| ***A63B 24/00*** | (2006.01) |
| *A41D 13/00* | (2006.01) |

(52) U.S. Cl.

CPC ..... *A41F 9/00* (2013.01); *A63B 21/0004* (2013.01); *A63B 21/00065* (2013.01); *A63B 21/00069* (2013.01); *A63B 21/00185* (2013.01); *A63B 21/0557* (2013.01); *A63B 21/4001* (2015.10); *A63B 21/4015* (2015.10); *A63B 21/4017* (2015.10); *A63B 21/4025* (2015.10); *A63B 21/4043* (2015.10); *A63B 23/035* (2013.01); *A63B 24/0062* (2013.01); *A41D 13/0015* (2013.01)

(58) Field of Classification Search

USPC ..... 482/1–148

See application file for complete search history.

(56) References Cited

U.S. PATENT DOCUMENTS

| | | | | |
|---|---|---|---|---|
| 3,759,510 A * | 9/1973 | Jackson, Jr. | ..... | A63B 21/065 482/105 |
| 5,186,701 A * | 2/1993 | Wilkinson | ..... | A41D 13/0015 482/121 |
| 5,203,754 A * | 4/1993 | Maclean | ..... | A63B 21/0004 482/121 |
| 5,306,222 A * | 4/1994 | Wilkinson | ..... | A41D 13/0015 482/121 |

(Continued)

*Primary Examiner* — Stephen Crow

(74) *Attorney, Agent, or Firm* — Mark David Torche; Patwrite LLC

(57) ABSTRACT

An enhanced resistance suit for use while training has a pair of compression shorts that have a plurality of attachment bands arranged in two columns down each leg. The attachment bands have at least one attachment ring secured on each in order to form a matched horizontal connectable pair. A user can removably attach resistance bands to the pairs to provide resistance while training. A pair of arm bands also have attachment rings connected to them and allow a user to removably connect a pair of arm resistance bands to a matching attachment band located on a waist portion of the shorts. A belt is provided to help secure the shorts. Shoes are used that also have attachment rings located on a heel portion and a toe portion to provide vertical jump training as well as calf muscle training. Sensors may be added to the suit to enhance use.

17 Claims, 10 Drawing Sheets

(56) References Cited

U.S. PATENT DOCUMENTS

| | | | | | |
|---|---|---|---|---|---|
| 5,308,305 | A * | 5/1994 | Romney | A63B 21/4025 | 2/69 |
| 5,570,472 | A * | 11/1996 | Dicker | A41D 13/0015 | 2/227 |
| 5,720,042 | A * | 2/1998 | Wilkinson | A41D 13/0015 | 2/69 |
| 5,993,362 | A * | 11/1999 | Ghobadi | A63B 21/0004 | 482/121 |
| 6,231,488 | B1 * | 5/2001 | Dicker | A41D 13/0015 | 2/69 |
| 7,153,246 | B2 * | 12/2006 | Koscielny | A61H 1/02 | 482/121 |
| 7,707,652 | B2 * | 5/2010 | Senegal | A63B 21/0552 | 2/102 |
| 7,744,511 | B2 * | 6/2010 | Grigoriev | A61F 5/0102 | 482/121 |
| 7,758,481 | B2 * | 7/2010 | Drennan | A61F 5/0193 | 482/121 |
| 8,083,644 | B2 * | 12/2011 | Purdy | A63B 21/0004 | 2/905 |
| 8,915,827 | B2 * | 12/2014 | Cranke | A63B 21/0557 | 36/132 |
| 8,968,166 | B2 * | 3/2015 | Cranke | A63B 21/0442 | 482/121 |
| 2007/0287616 | A1 * | 12/2007 | Weaver | A63B 21/0004 | 482/124 |
| 2012/0246795 | A1 * | 10/2012 | Scheffler | A41D 1/002 | 2/69 |
| 2012/0283077 | A1 * | 11/2012 | Cranke | A63B 21/0442 | 482/124 |

* cited by examiner

ENHANCED BIONIC RESISTANCE SUIT

CROSS REFERENCE TO RELATED APPLICATIONS

This application is a continuation in part of U.S. patent application Ser. No. 14/214,985, filed Mar. 16, 2014, the complete disclosures of each of which are hereby incorporated by reference.

BACKGROUND OF THE INVENTION

It is well known that exercise contributes to health in a number of positive ways and athletes especially need to train in order to maintain and excel in their sport. In many sports, athletes condition their muscles using a technique known as resistance training. The resistance is increased as the muscles get used to higher amounts of resistance which makes them faster and stronger. In additional to training, athletes also train in the field, but to increase the training, apparatus is sometimes used such as weight vests, ankle weights, weighted sleds, parachutes and resistance harnesses. While these things may give some help in the training, they fail to provide the full effect of a gym resistance workout.

There is a need for a suit that can be worn by an athlete while training that provides the benefits of a resistance workout during simulations and fitness training.

SUMMARY OF THE INVENTION

An enhanced resistance suit for use while training has a pair of compression shorts that have a plurality of attachment bands arranged in two columns running down each leg. The attachment bands have at least one attachment ring secured on each in order to form a matched horizontal connectable pair. A user can removably attach resistance bands to the pairs to provide resistance while training. A pair of arm bands also have attachment rings connected to them and allow a user to removably connect a pair of arm resistance bands to a matching attachment band located on a waist portion of the shorts. A belt is provided to help secure the shorts. Shoes are used that also have attachment rings located on a heel portion and a toe portion to provide vertical jump training as well as calf muscle training. Sensors may be added to the suit to enhance use.

Other features and advantages of the instant invention will become apparent from the following description of the invention which refers to the accompanying drawings.

DETAILED DESCRIPTION OF THE INVENTION

Figure 1:
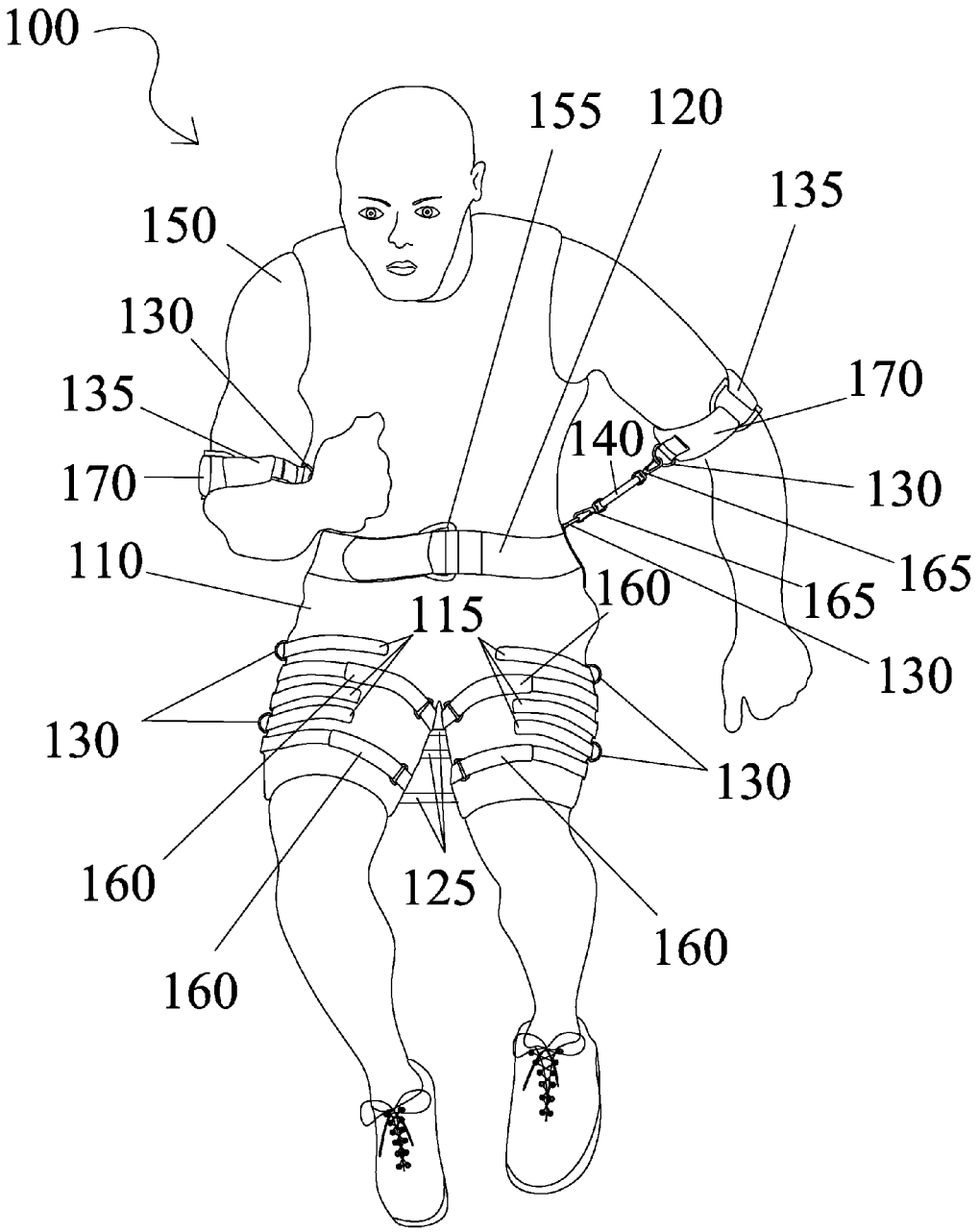
FIG. 1 is a front view of an athlete wearing an enhanced resistance suit according to an embodiment of the present invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Figure 2:
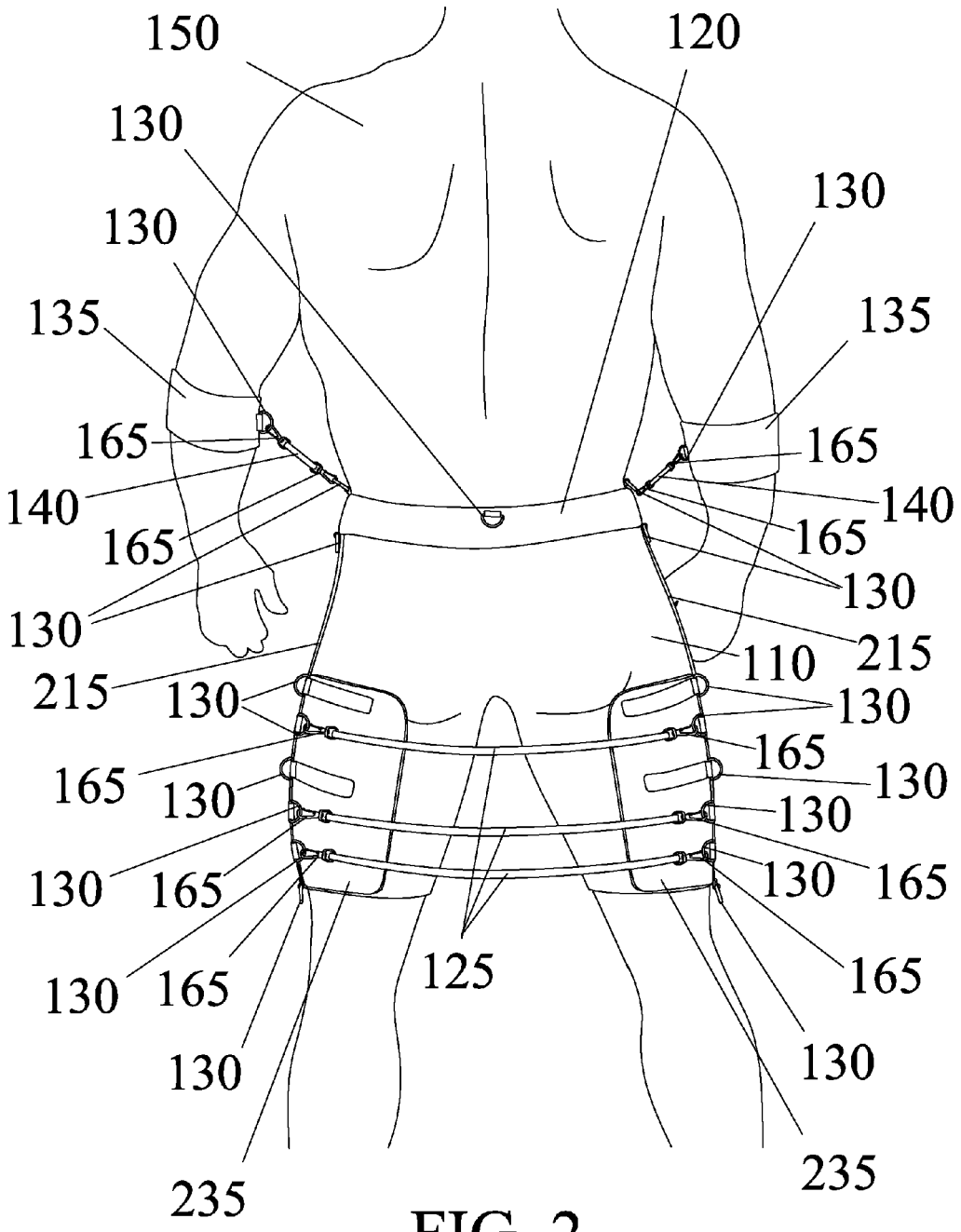
FIG. 2 is a back view of the enhanced resistance suit shown in FIG. 1.

Referring to FIGS. 1 and 2, an enhanced resistance suit 100 is shown having a compression garment—shorts, long shorts or pants 110 (although shorts 110 are illustrated, it is understood that they could be any length from shorts to full length compression pants with no change in the basic functionality of the invention; however, for simplicity, shorts will be discussed and illustrated.) Compression shorts 110 have a plurality of horizontal attachment bands 115 which are reinforced to allow shorts 110 to withstand the resistance force. A plurality of attachment rings 130 are provided to allow a user 150 to selectively attach a resistance band 125 to a leg portion or an arm resistance band 140 to provide the desired resistance workout. The attachment rings 130 are arranged in two columns; at least one on each attachment band 115 so that a connectable pairing is formed allowing the user 150 to connect resistance bands 125 horizontally between the paired attachment rings 130. Leg adjustment bands 160 are provided to allow a user to snug compression shorts 110 and customize the fit by pulling leg adjustment bands 160 and securing them using hook and loop fasteners or buckles as is known in the art.

A vertical attachment band 215 is attached to each leg and provides reinforcement for attachment rings 130. Vertical attachment band 215 is sewn into compression shorts to stiffen and reinforce them. Resistance bands 125 provide resistance in five pound increments starting with 5, 10, 15, etc. up to 120 pounds. Of course other values could be provided to suit particular uses or specifications. Similarly, arm resistance bands 140 may be selected to meet the particular needs of the user. Additionally, multiple resistance bands 125 may be connected to selected attachment rings 130 to provide further resistance and customization to target specific muscles and training routines. Pads 235 are provided to cushion and reduce the pressure applied by resistance bands 120 when in use. Pads may be sewn in or be removable.

A belt 120 is provided to help reinforce the upper attachment rings and to provide support in holding compression shorts 110 in place. A buckle 155 is used to secure belt 120 at the desired comfort level. Of course other means may be used to secure belt 120 in place, such as hook and loop fasteners, snaps, etc. Additionally, compression shorts 110 may have a fly portion in front to aid in putting on and taking off as is known in the art. They fly portion may be a zipper, hook and loop fasters, snaps, buttons or other acceptable closing means as is known in the art. Compression shorts 110 are made of neoprene to ensure that they can stand up to the resistance forces provided by resistance bands 140. Of course other suitable materials may be used as long as compression shorts are strong enough to hold their shape during training.

A pair of arm bands 135 are provided to allow a user 150 to resistance train their arm muscles while participating in simulations or other athletic activities. Each arm band 135 includes an arm adjustment band 170 that allows user 150 to adjust arm band 135 to fit comfortably on their arm. Arm adjustment band 170 uses a hook and loop fastener to allow the user to comfortably fit arm band 135. Of course other adjustment means may be used such as buckles, clips, buttons or snaps. Each arm band 135 has attachment ring 130 that is removably connected by a connector 165 to arm resistance band 140 which connects to attachment ring 130 attached to a waist portion using another connector 165. Connectors 165 use a spring loaded keep to ensure that they don't come loose during use. Of course other kinds of connectors could be used such as carabiners or other suitable connectors. Additionally, Attachment bands 115 are horizontally disposed on compression shorts 110. Resistance bands 125 are stretched horizontally across the hamstrings to provide the resistance training.

Figure 3:
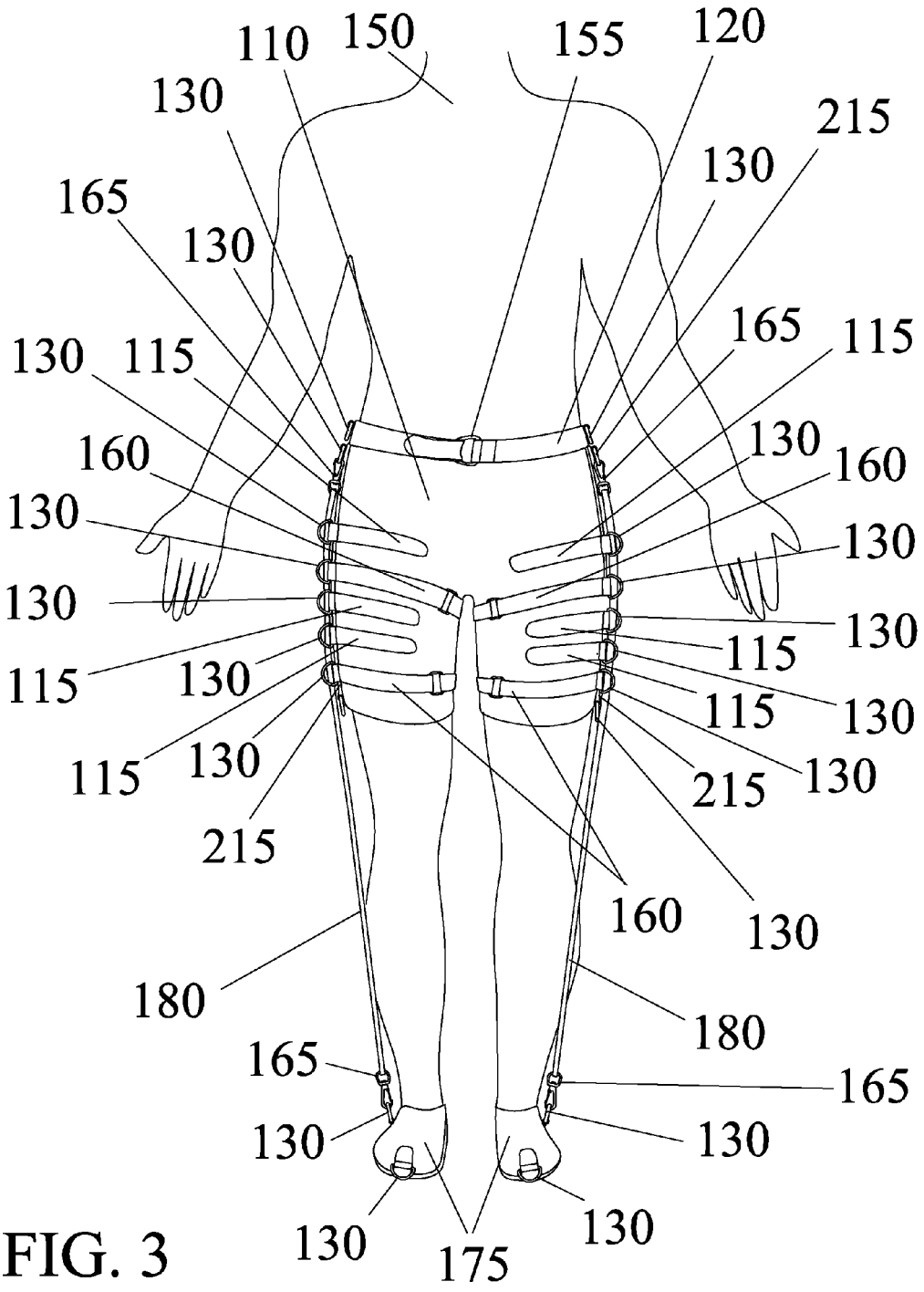
FIG. 3 is a front view of the enhanced resistance suit equipped for vertical jump training.
Figure 4:
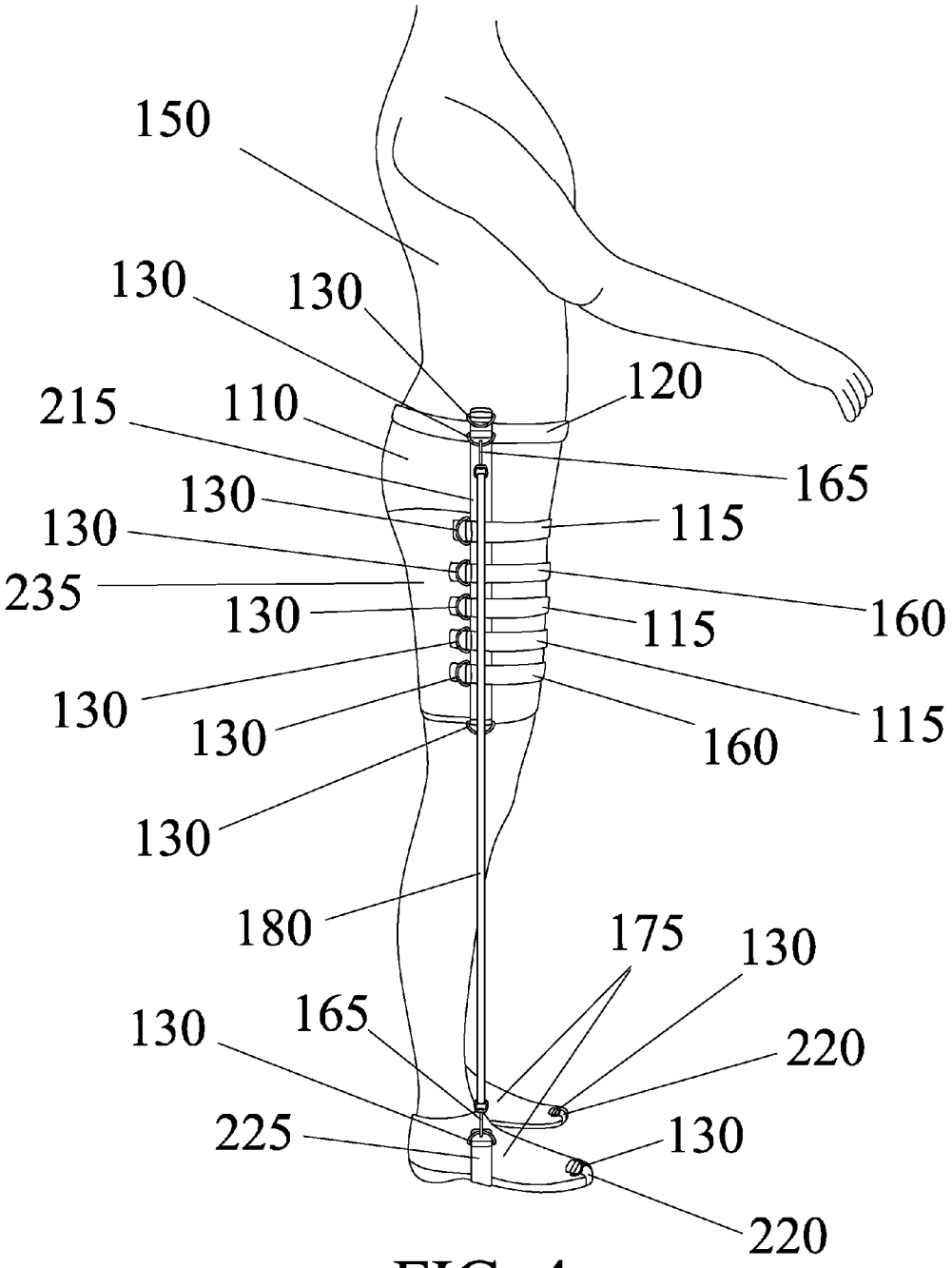
FIG. 4 is a side view of the enhanced resistance suit shown in FIG. 4.
Figure 5:
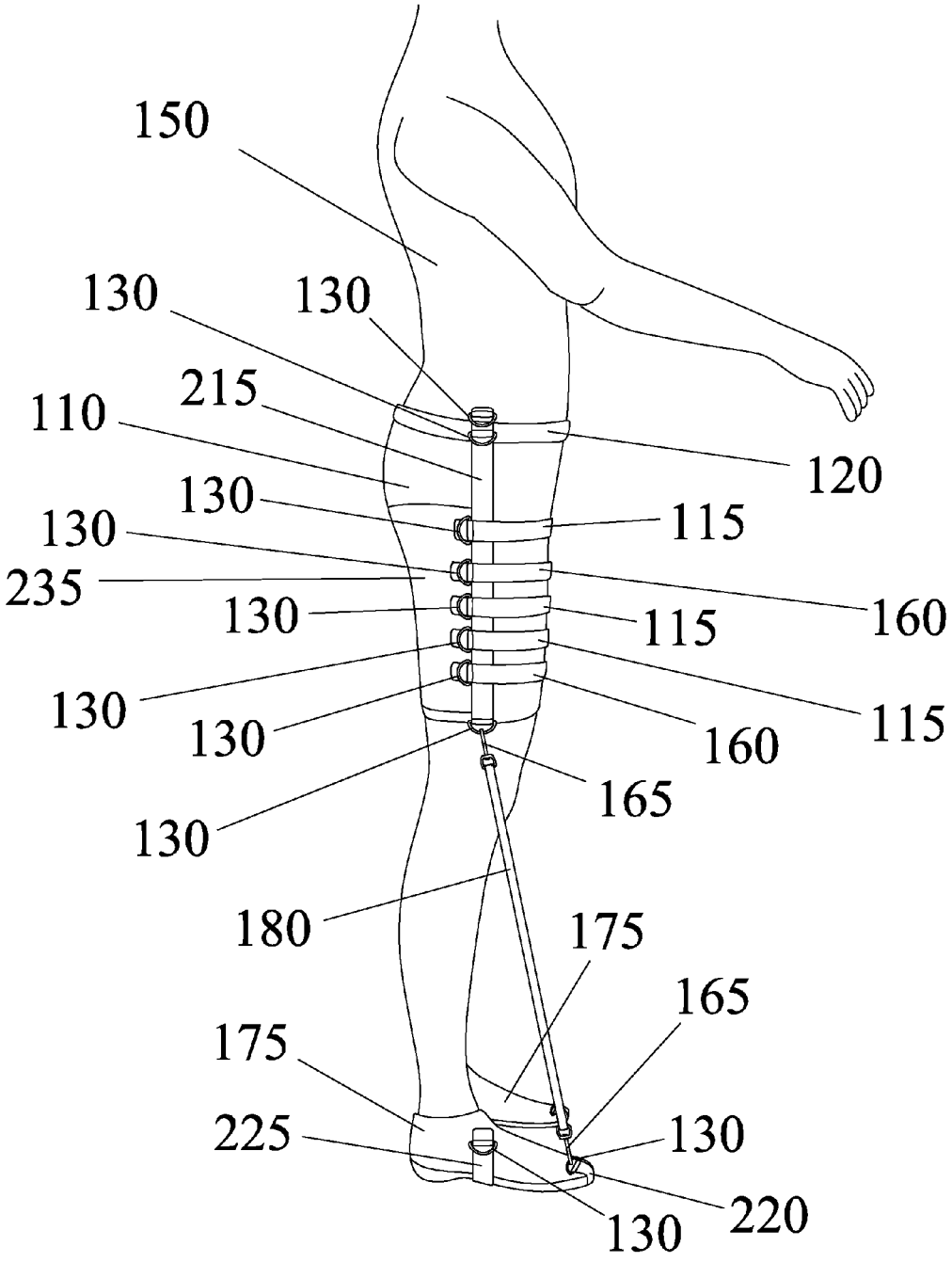
FIG. 5 is a side view of the enhanced resistance suit shown in FIG. 1 equipped for calf muscle training.

Referring now to FIGS. 3, 4 and 5, enhance resistance suit is shown adapted for vertical jump training. A vertical resistance strap 180 is attached to attachment ring 130 that is located on the waist of compression shorts 110 and to an attachment ring that is attached to a shoe 175. For vertical jump training, the shoe attachment ring 130 is located on an outside portion near the ankle of shoe 175 that is attached to a heel attachment band 225. This allows a user to jump while experiencing the resistive force of vertical resistance strap 180.

To exercise the calf muscles, vertical resistance strap 180 is attached to attachment ring 130 that is located at the bottom of compression shorts 110 and to the attachment ring 130 located on a toe attachment band 220. This exercises the calf muscles.

Figure 6:
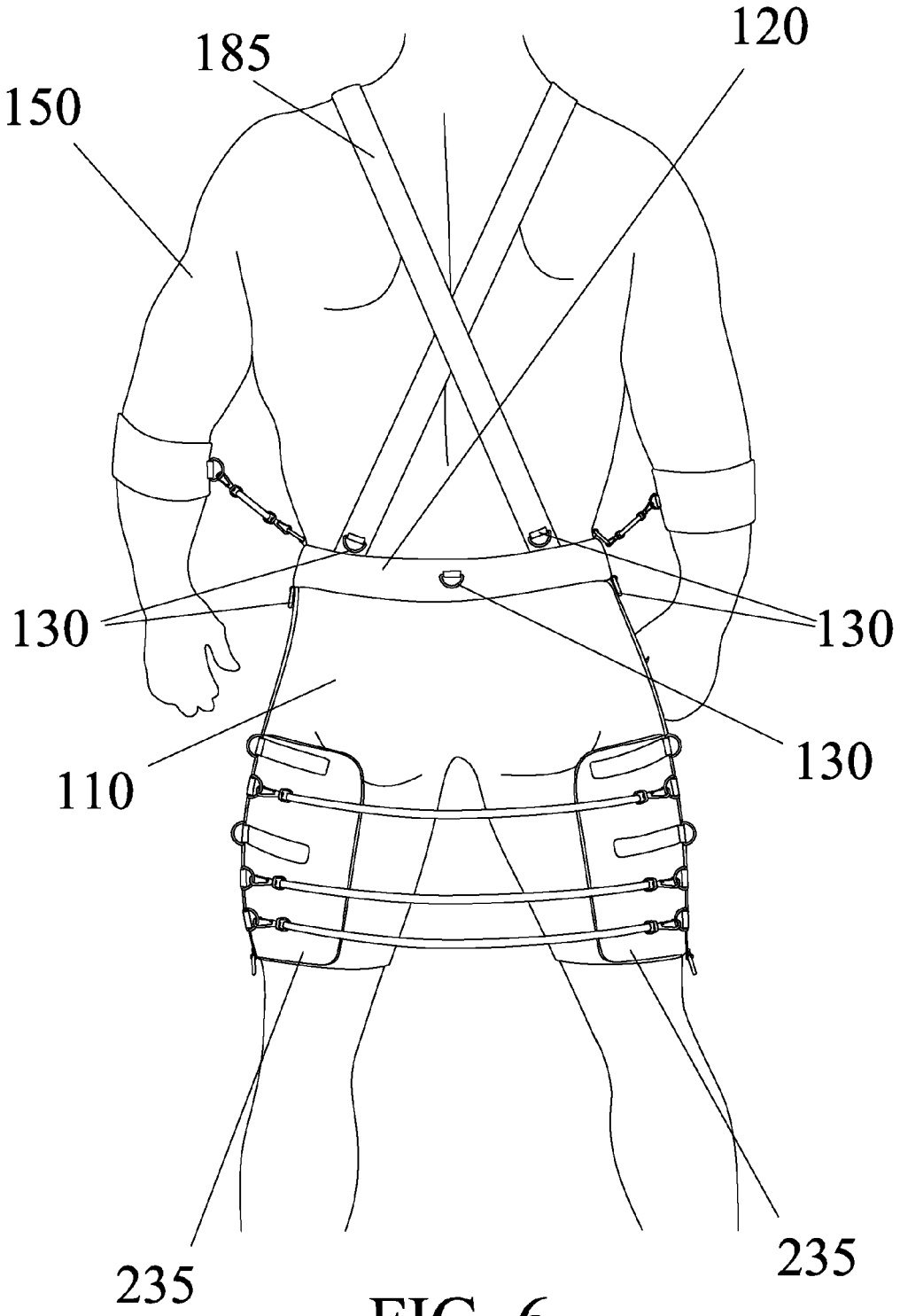
FIG. 6 is a back view of the enhanced resistance suit shown in FIG. 1 equipped with suspenders.
Figure 7:
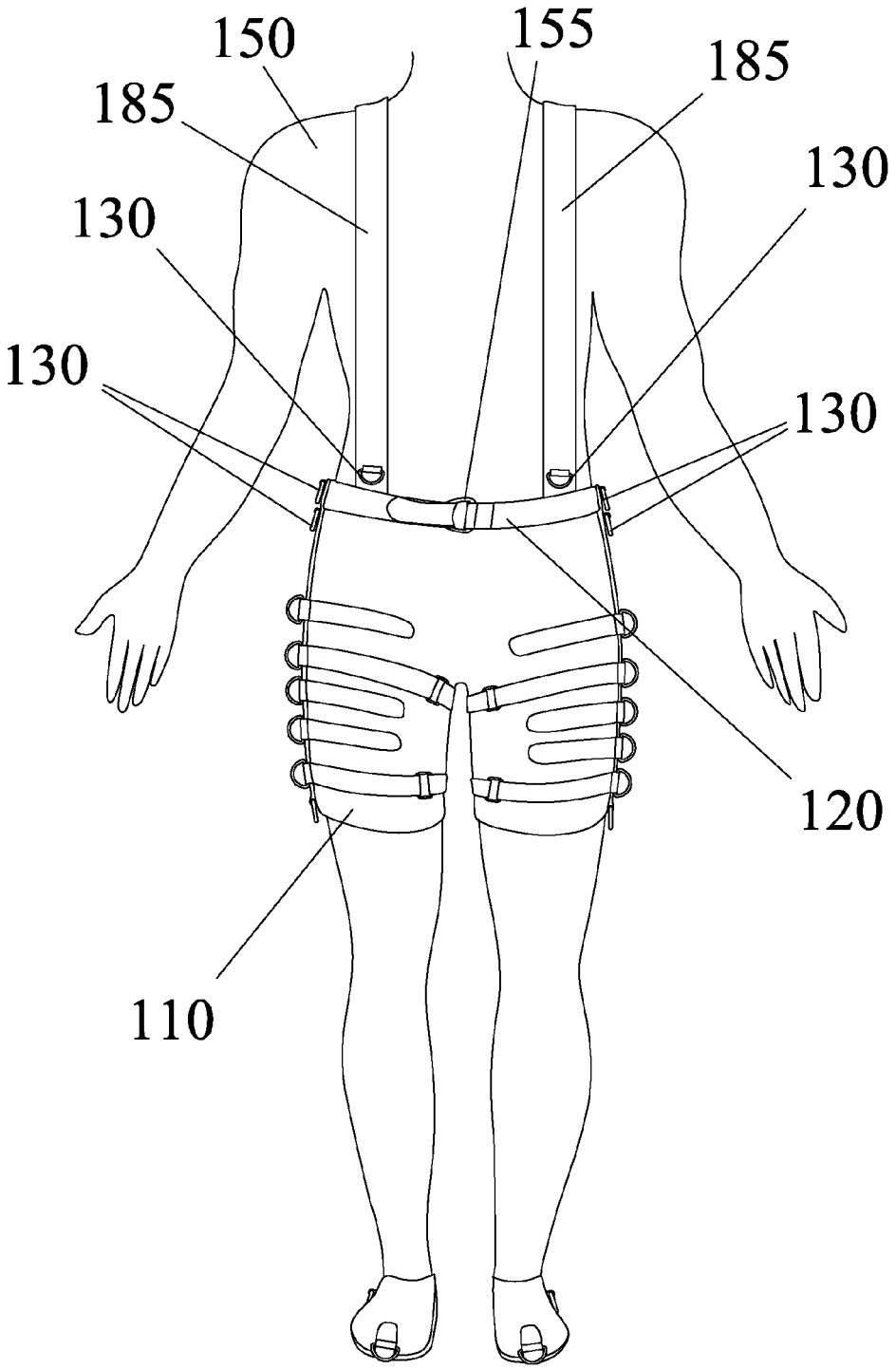
FIG. 7 is a front view of the enhanced resistance suit shown in FIG. 6.

Referring now to FIGS. 6 and 7, a pair of suspenders 185 is provided to add attachment points and to help hold compression shorts 110 in place. Suspenders 185 are sewn to compression shorts 110 but may be attached with clips, buttons or other securing means that allow the user to remove them when not needed.

Figure 8:
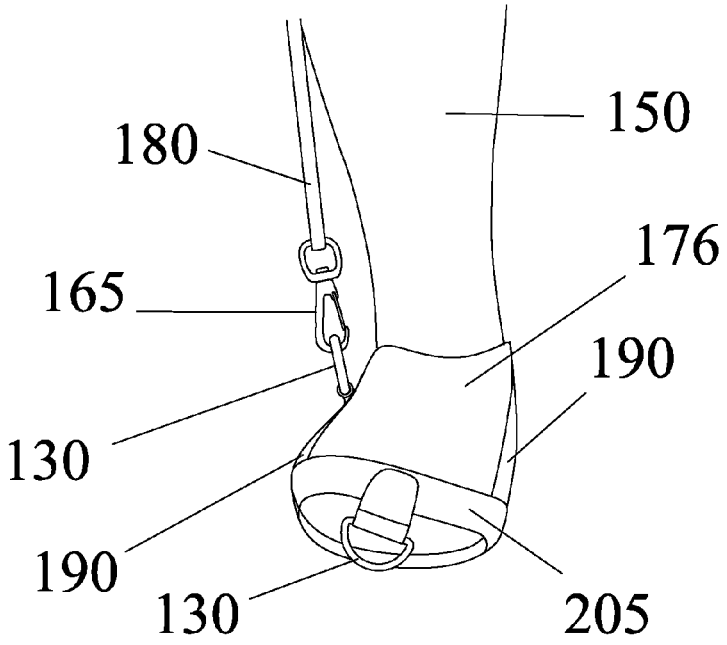
FIG. 8 is a front close up view of a shoe equipped for vertical jump training shown in FIG. 3.
Figure 9:
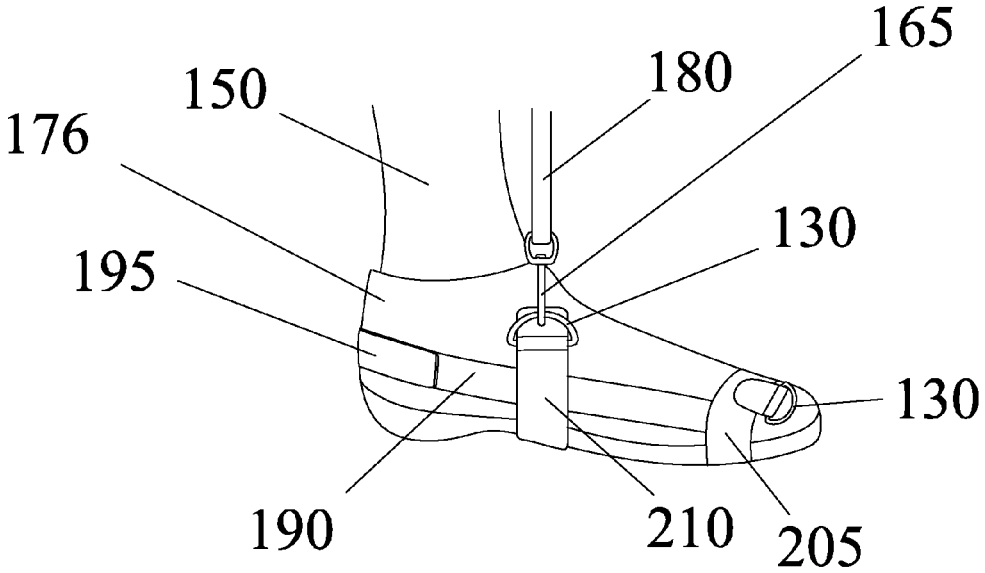
FIG. 9 is a side close up view of the shoe shown in FIG. 8.

Now referring to FIGS. 8 and 9, a shoe harness 190 is provided to allow user 150 use any shoe 176 rather than shoe 175 that is specially adapted for use with enhanced resistance suit 100. Shoe harness 190 wraps around shoe 176 and is secured using shoe adjustment band 195. Shoe adjustment band 195 is a hook and loop fastener but other securing means may be used such as buttons, snaps or other suitable adjustable securing means. In this embodiment, heel band 210 is attached to shoe harness 190 as well as toe band 205. This provides the connecting points needed to utilize the vertical jump and calf routines as discussed above.

Figure 10:
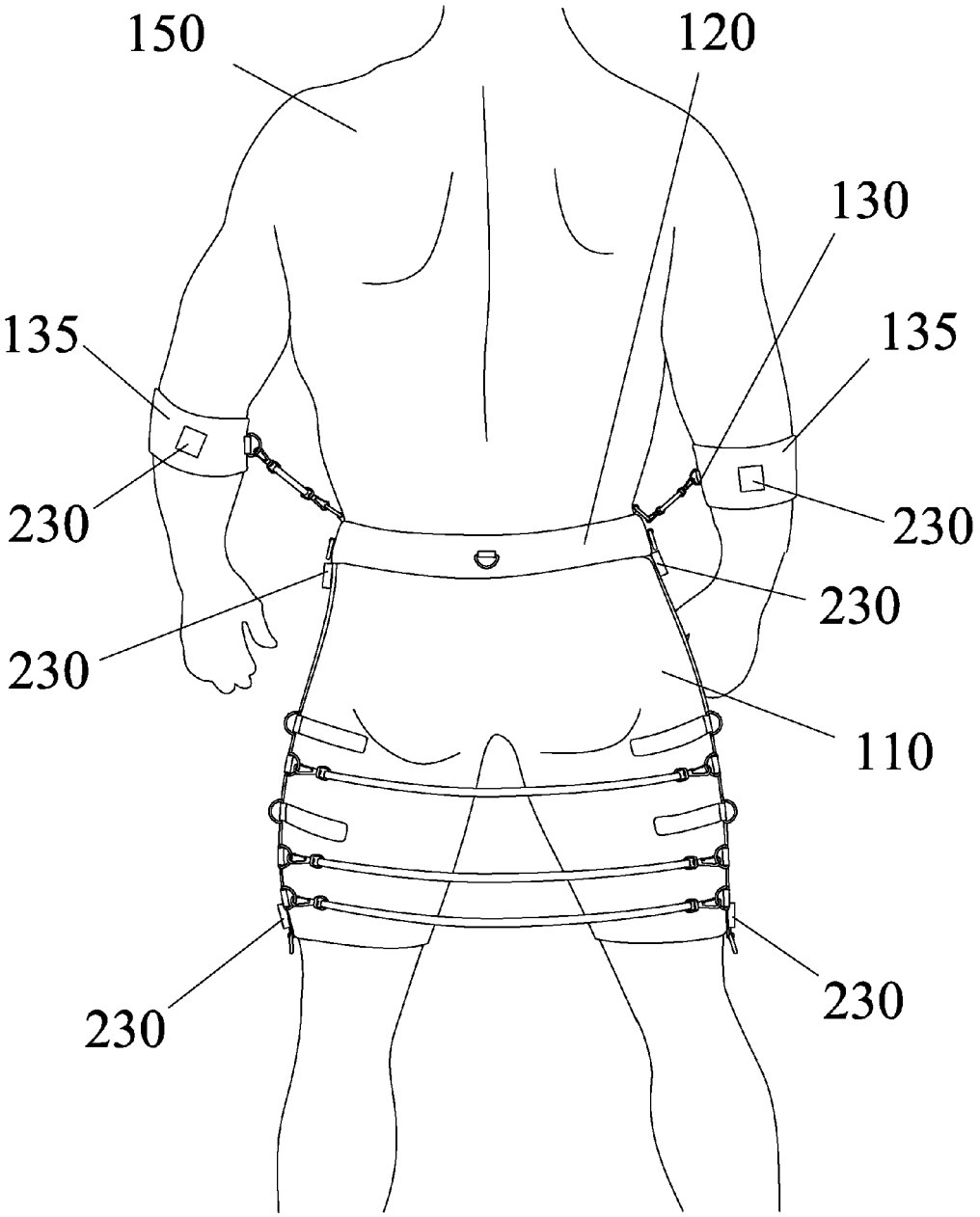
FIG. 10 is a back view of the enhanced resistance suit equipped with sensors.
Figure 11:
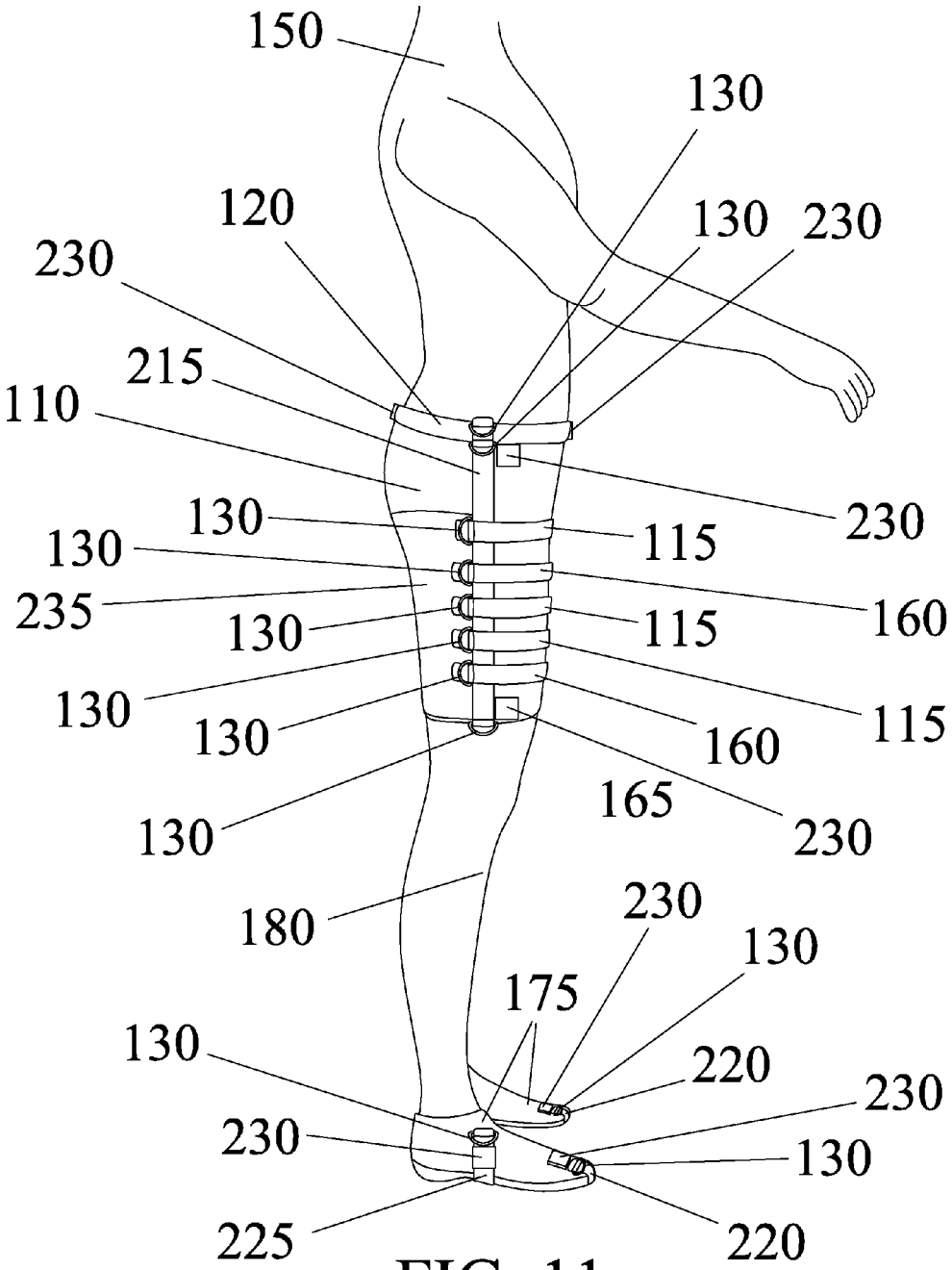
FIG. 11 is a side view of the enhanced resistance suit shown in FIG. 10.

Referring to FIGS. 10 and 11, enhanced resistance suit 100 is shown with sensors 230 attached at various locations to help the user gather data while wearing enhanced resistance suit 100 to improve their results while training. Sensors 230 may be accelerometers that track speed and forces experienced while wearing the suit. Sensors 230 may be detachable using hook and loop fasteners or sensors 230 may be permanently mounted. Sensors may be located in different locations to allow users to customize the information desired. Additionally, although five attachment bands are depicted, fewer or more bands may be used to further customize the suit to meet specific activities. Also, attachment rings 130 may be located at other locations to provide additional functionality. The user may add or subtract resistance bands 125 to tailor the resistance provided. The user may connect one, two, three, four or five resistance bands by attaching them to the appropriate attachment rings 130. Other kinds of sensors such as location, biometric data such as heart rate, etc. may be used as is known in the art.

Although the instant invention has been described in relation to particular embodiments thereof, many other variations and modifications and other uses will become apparent to those skilled in the art.

What is claimed is:

1. An enhanced resistance suit for use while training comprising:

a compression garment;

said compression garment having a shorts portion;

said shorts portion having two leg portions;

each of said two leg portions having a plurality of substantially horizontal attachment reinforcement bands disposed thereon;

said plurality of attachment reinforcement bands being disposed in two columns opposite each other having an equal number of attachment bands in each column;

at least one attachment ring disposed on each of said plurality of attachment reinforcement bands wherein said attachment rings are securely held in place;

said attachment rings being oppositely disposed to each other forming a connectable pair; and at least one horizontal resistance band adapted to removably connect to said connectable pair.

2. The enhanced resistance suit for use while training according to claim 1 further comprising:

a pair of arm bands;

said pair of arm bands having an adjustment portion adapted to allow a user to removably secure said pair of arm bands to an arm portion thereof:

an attachment ring secured to each of said pair of arm bands;

at least one arm resistance band adapted to removably connect to said attachment ring on said arm band and a matching attachment ring disposed on a waist portion of said shorts portion.

3. The enhanced resistance suit for use while training according to claim 1 wherein said compression garment is made of neoprene.

4. The enhanced resistance suit for use while training according to claim 1 further comprising:

a pair of suspenders secured to a top portion of said shorts portion;

said pair of suspenders having at least a pair of attachment rings secured thereon.

5. The enhanced resistance suit for use while training according to claim 1 further comprising a belt secured to a top portion of said shorts portion.

6. The enhanced resistance suit for use while training according to claim 5 further comprising at least one attachment ring secured to said belt.

7. The enhanced resistance suit for use while training according to claim 1 further comprising at least one sensor disposed on said compression garment wherein data is electronically gathered.

8. The enhanced resistance suit for use while training according to claim 7 wherein said at least one sensor is a sensor to detect acceleration.

9. The enhanced resistance suit for use while training according to claim 1 further comprising:

a pair of shoes;

said shoes having a heel attachment ring disposed on an outside portion proximal to a heel portion on each of said pair of shoes;

a pair of vertical resistance straps; and each of said pair of vertical resistance straps having a connector on a top end and a bottom end; wherein said top end is removably connectable to a waist attachment ring disposed on a side of said shorts portion and said bottom end is removably connectable to said heel attachment ring.

10. The enhanced resistance suit for use while training according to claim 1 further comprising:

a pair of shoes;

said shoes having a toe attachment ring disposed on an outside portion proximal to a toe portion on each of said pair of shoes;

a pair of vertical resistance straps; and each of said pair of vertical resistance straps having a connector on a top end and a bottom end; wherein said top end is removably connectable to a bottom attachment ring disposed on a side of said shorts portion and said bottom end is removably connectable to said toe attachment ring.

11. The enhanced resistance suit for use while training according to claim 1 further comprising:

a pair of shoe harnesses;

each of said shoe harnesses being adapted to removably wrap around a shoe and be secured thereon;

a heel attachment band secured to said shoe harness;

a toe attachment band secured to said shoe harness;

a heel attachment ring secured to said heel attachment band; and a toe attachment portion secured to said toe attachment band.

12. The enhanced resistance suit for use while training according to claim 11 further comprising:

a pair of vertical resistance straps; and each of said pair of vertical resistance straps having a connector on a top end and a bottom end; wherein said top end is removably connectable to a waist attachment ring disposed on a side of said shorts portion and said bottom end is removably connectable to said heel attachment ring.

13. The enhanced resistance suit for use while training according to claim 11 further comprising:

a pair of vertical resistance straps; and each of said pair of vertical resistance straps having a connector on a top end and a bottom end; wherein said top end is removably connectable to a bottom attachment ring disposed on a side of said shorts portion and said bottom end is removably connectable to said toe attachment ring.

14. The enhanced resistance suit for use while training according to claim 10 further comprising at least one sensor disposed on each of said pair of shoes wherein data is electronically gathered.

15. The enhanced resistance suit for use while training according to claim 1 further comprising at least one leg adjustment band disposed on each of said two leg portions wherein said leg adjustment band is adapted to adjustably secure said leg therein.

16. The enhanced resistance suit for use while training according to claim 6 wherein said at least one attachment ring is disposed on a middle back waist portion of said belt.

17. The enhanced resistance suit for use while training according to claim 1 further comprising at least one pair of leg adjustment bands;

said at least one pair of leg adjustment bands having a hook and loop portion;

said plurality of attachment reinforcement bands having a complimentary hook and loop portion whereby said at least one pair of leg adjustment bands is selectively disposed on said plurality of attachment reinforcement bands to compress said shorts portion against a user's leg.

* * * * *